US011724505B1

(12) United States Patent
Liao et al.

(10) Patent No.: US 11,724,505 B1
(45) Date of Patent: Aug. 15, 2023

(54) MAINTENANCE SYSTEM FOR SPRAY HEAD, INKJET PRINTER, MAINTENANCE METHOD AND PRINTING METHOD

(71) Applicant: SHENZHEN CNTOP DIGITAL EQUIPMENT CO., LTD., Shenzhen (CN)

(72) Inventors: Shuzhang Liao, Shenzhen (CN); Hua Jiang, Shenzhen (CN); Leile Zeng, Shenzhen (CN); Wei Lin, Shenzhen (CN)

(73) Assignee: SHENZHEN CNTOP DIGITAL EQUIPMENT CO., LTD., Shenzhen (CN)

( * ) Notice: Subject to any disclaimer, the term of this patent is extended or adjusted under 35 U.S.C. 154(b) by 0 days.

(21) Appl. No.: 17/946,107

(22) Filed: Sep. 16, 2022

(51) Int. Cl.
*B41J 2/17* (2006.01)
*B41J 2/18* (2006.01)

(52) U.S. Cl.
CPC ..... *B41J 2/1707* (2013.01); *B41J 2/18* (2013.01)

(58) Field of Classification Search
CPC .... B41J 2/1707; B41J 2/1714; B41J 2/16517; B41J 2/16526; B41J 2/16535; B41J 2/18; B41J 2/19
See application file for complete search history.

(56) References Cited

U.S. PATENT DOCUMENTS

| | | | | |
|---|---|---|---|---|
| 8,833,897 | B2 * | 9/2014 | Murata | B41J 2/16535 347/17 |
| 11,267,248 | B2 * | 3/2022 | Komatsu | B41J 2/19 |
| 2022/0297433 | A1 * | 9/2022 | Benton | B41J 2/16526 |

FOREIGN PATENT DOCUMENTS

| | | | |
|---|---|---|---|
| CN | 110328973 | A | 10/2019 |
| CN | 113829757 | A | 12/2021 |
| JP | H05330073 | A | 12/1993 |
| JP | 2012140003 | A | 7/2012 |
| JP | 2018149764 | A | 9/2018 |
| JP | 2019212393 | A | 12/2019 |

* cited by examiner

*Primary Examiner* — An H Do
(74) *Attorney, Agent, or Firm* — IPro, PLLC; Na Xu

(57) ABSTRACT

A maintenance system for spray head includes an ink cavity of the spray head communication with the external environment through spray holes. The ink cavity of the spray head is connected with a first accommodating cavity of a first regulating device through a pipeline; when the ink in the ink circulation loop is in a circulating flow state, the ink flows into the ink cavity of the spray head from the first accommodating cavity; because the first accommodating cavity and the ink cavity of the spray head are in a communication state, the change of the first air pressure within the first negative pressure range can make the ink in the first accommodating cavity and the ink cavity of the spray head oscillate at the same time.

20 Claims, 7 Drawing Sheets

MAINTENANCE SYSTEM FOR SPRAY HEAD, INKJET PRINTER, MAINTENANCE METHOD AND PRINTING METHOD

PRIORITY CLAIM

This application claims the benefit of and priority to the PCT Application Number: PCT/CN2022/109110, filed to the Chinese patent office on Jul. 29, 2022 and entitled "Maintenance system for spray head, inkjet printer, maintenance method and printing method", which is hereby incorporated by reference in its entirety.

TECHNICAL FIELD

Embodiments of the present application relate to the technical field of inkjet printers, and in particular, relate to a maintenance system for a spray head, an inkjet printer, a maintenance method and a printing method.

BACKGROUND

Inkjet printers belong to a technology of ejecting ink onto a printing medium through spray holes of a spray head to print images or texts. In the field of inkjet printing, with the increase of printing time, the ink may agglomerate and adhere in the spray head of the inkjet printer and then it may get dried and solidified into dregs to cause complete or partial blockage of the spray holes, which makes the spray head of the inkjet printer unable to work normally and affects the printing quality.

In order to keep the spray holes of the inkjet printer in an unblocked state, it is necessary to regularly clean and maintain the spray head of the inkjet printer. The existing cleaning method usually pumps the cleaning liquid directly into the spray head of the inkjet printer through a liquid supply pump, so that the cleaning liquid flowing inside the spray head dissolves and takes away the ink which has agglomerated and adhered in the spray head and solidified into dregs. However, the cleaning liquid that is pumped into the spray head will generate a great impact force on the spray head, which is likely to damage the delicate spray head.

SUMMARY

In a first aspect of the present application, a maintenance system for a spray head is provided, and the system includes a controller and an ink circulation loop. The ink circulation loop includes a main container, a first regulating device and a spray head which are arranged in sequence along the ink delivery direction; wherein the first regulating device is respectively connected with the main container and the spray head through pipelines, the spray head is connected with the main container, and the first regulating device is connected with the controller. The main container is configured to store ink; the first regulating device includes a first accommodating cavity for storing first gas and ink flowing in from the main container; the first regulating device is configured to regulate a first air pressure of the first gas; the spray head includes an ink cavity and a plurality of spray holes, the ink cavity is in communication with the external environment through the spray holes, and the ink cavity is connected with the first accommodating cavity and the main container through pipelines. The controller is configured to: when the ink in the ink circulation loop is in a circulating flow state, control the first air pressure to change within a first negative pressure range by the first regulating device to make the ink in the ink cavity oscillate, wherein the oscillation direction of the ink includes the length direction of the spray holes.

In some embodiments, the first negative pressure range includes a first maximum value and a first minimum value of the first air pressure; the controller is specifically configured to: control the first air pressure to change between the first maximum value and the first minimum value by the first regulating device, so that the position of the liquid level formed by the ink in the ink cavity and the spray holes correspondingly changes between a first position and a second position; wherein the second position is far away from the ink cavity relative to the first position.

In some embodiments, the controller is specifically configured to control, by the first regulating device, the first air pressure to change periodically within the first negative pressure range according to a preset period to make the ink in the ink cavity oscillate periodically.

In some embodiments, the ink circulation loop further includes a second regulating device, and the second regulating device is respectively connected with the spray head and the main container through pipelines; the second regulating device includes a second accommodating cavity for storing second gas and ink flowing in from the spray head, the second regulating device is configured to regulate the second air pressure of the second gas; the controller is further configured to: control the second air pressure to change within a second negative pressure range by the second regulating device so that the negative pressure in the second containing cavity is larger than the negative pressure in the first containing cavity; wherein the first air pressure and the second air pressure change in the same preset period.

In some embodiments, when the first air pressure and the second air pressure change in the same preset period, the difference between the first air pressure and the second air pressure is within a preset difference range.

In some embodiments, the second negative pressure range includes a second maximum value and a second minimum value of the second air pressure; the controller is further specifically configured to: control the second air pressure to change between the second maximum value and the second minimum value by the second regulating device, so that the position of the liquid level formed by the ink in the ink cavity and the spray holes correspondingly changes between the first position and the second position; wherein the second position is far away from the ink cavity relative to the first position.

In some embodiments, the first regulating device includes a first container, a first air pressure regulating device and a first detection device, wherein the first container includes a first accommodating cavity; the first air pressure regulating device is connected with a gas delivery port of the first container through a pipeline, the first air pressure regulating device is configured to regulate the first air pressure; and the first detection device is used for detecting the first air pressure. The controller is communicatively connected with the first air pressure regulating device and the first detection device, the controller is configured to: acquire detection data of the first air pressure through the first detection device, and control the first air pressure regulating device to regulate the value of the first air pressure according to the detection data of the first air pressure.

In some embodiments, the second regulating device includes a second container, a second air pressure regulating device and a second detection device; wherein the second container includes a second accommodating cavity; the second air pressure regulating device is connected with a gas delivery port of the second container through a pipeline, the second air pressure regulating device is configured to regulate the second air pressure; the second detection device is used for detecting the second air pressure; the controller is communicatively connected with the second air pressure regulating device and the second detection device, the controller is configured to: acquire detection data of the second air pressure through the second detection device, and control the second air pressure regulating device to regulate the value of the second air pressure according to the detection data of the second air pressure.

In some embodiments, the ink circulation loop further includes a first ink conveying device which is respectively connected with the main container and the first container through pipelines, and the first ink conveying device is configured to convey the ink contained in the main container to the first container.

In some embodiments, the ink circulation loop further includes a second ink conveying device which is respectively connected with the second container and the main container through pipelines, and the second ink conveying device is configured to convey the ink contained in the second container to the main container.

In some embodiments, the ink circulation loop further includes a first ink processing device which is respectively connected with the first container and the first ink conveying device through pipelines; and the first ink processing device is configured to purify the ink output by the first ink conveying device.

In some embodiments, the ink circulation loop further includes a second ink processing device which is respectively connected with the first container and the spray head through pipelines; and the second ink processing device is configured to purify the ink output from the first container.

In a second aspect of the present application, an inkjet printer is provided, and the inkjet printer includes the system described in the first aspect.

In a third aspect of the present application, a maintenance method for a spray head applied to an inkjet printer is provided, and the method is used for maintenance of the spray head of the inkjet printer, wherein the spray head includes a liquid inlet, a liquid outlet, an ink cavity and a plurality of spray holes, wherein one end of the ink cavity is in communication with the liquid inlet, the other end of the ink cavity is in communication with the liquid outlet, the ink cavity is in communication with the external environment through the spray holes, and the air pressure at the end of the liquid inlet of the spray head is a first air pressure.

In some embodiments, the first negative pressure range includes a first maximum value and a first minimum value of a first air pressure; the step of controlling the first air pressure to change within a first negative pressure range to make the ink in the ink cavity oscillate specifically includes: controlling the first air pressure to change between the first maximum value and the first minimum value so that the position of the liquid level formed by the ink in the ink cavity and the spray holes correspondingly changes between a first position and a second position; wherein the second position is far away from the ink cavity relative to the first position.

In some embodiments, the step of controlling the first air pressure to change within a first negative pressure range to make the ink in the ink cavity oscillate specifically includes: controlling the first air pressure to change periodically within the first negative pressure range according to a preset period to make the ink in the ink cavity oscillate periodically.

In some embodiments, the air pressure at the end of the liquid outlet of the spray head is a second air pressure; the above-mentioned method further includes: controlling the second air pressure to change within a second negative pressure range so that the second negative pressure is greater than the first negative pressure; wherein the first air pressure and the second air pressure change in the same preset period.

In some embodiments, when the first air pressure and the second air pressure change in the same preset period, the difference between the first air pressure and the second air pressure is within a preset difference range.

In some embodiments, the second negative pressure range includes a second maximum value and a second minimum value of the second air pressure; the step of controlling the second air pressure to change within a second negative pressure range includes: controlling the second air pressure to change between the second maximum value and the second minimum value, so that the position of the liquid level formed by the ink in the ink cavity and the spray holes correspondingly changes between the first position and the second position; wherein the second position is far away from the ink cavity relative to the first position.

In a fourth aspect of the present application, a printing method applied to an inkjet printer is provided, and in the method, work order data of an image to be printed is acquired by the inkjet printer, the spray head is controlled to print on a printing medium according to the work order data, and the spray head is maintained according to the method described in the second aspect during the idle time of printing, and after the spray head maintenance is completed, new work order data is acquired and the spray head is controlled to print on the printing medium.

In a fifth aspect of the present application, a nonvolatile computer readable storage medium is provided, and the computer readable storage medium stores computer-executable instructions which, when executed by an inkjet printer, cause the inkjet printer to execute the method described in the third aspect or the fourth aspect.

In a sixth aspect of the present application, a computer program product is provided, the computer program product includes a computer program stored on a nonvolatile computer readable storage medium, and the computer program includes program instructions which, when executed by an inkjet printer, cause the inkjet printer to execute the method described in the third aspect or the fourth aspect.

It shall be appreciated that, what described in the Summary section is not intended to limit the key or important features of the present disclosure, and it is not intended to limit the scope of the present disclosure. Other features of the present disclosure will be readily appreciated from the following description.

BRIEF DESCRIPTION OF THE DRAWINGS

One or more embodiments are illustrated by pictures in corresponding attached drawings, and this does not constitute limitation on the embodiments. Elements with the same reference numerals in the attached drawings are shown as similar elements, and the pictures in the attached drawings do not constitute scale limitation unless otherwise stated particularly.

DETAILED DESCRIPTION

Hereinafter, the principles and spirit of the present disclosure will be described with reference to several exemplary embodiments shown in the attached drawings. It shall be appreciated that, these specific embodiments are described only to enable those skilled in the art to better understand and realize the present disclosure, and are not intended to limit the scope of the present disclosure in any way. In the following description and claims, unless otherwise defined, all technical and scientific terms used herein have the meanings commonly understood by those of ordinary skill in the art.

As used herein, the term "comprising" and similar terms should be construed as open inclusion, i.e., "comprising but not limited to". The term "based on" should be construed as "at least partially based on". The term "one embodiment" or "the embodiment" should be construed as "at least one embodiment". The terms "first", "second" or the like can refer to different or the same objects, and they are only used to distinguish the referred objects, without implying the specific spatial order, chronological order, order of importance or the like of the referred objects.

The inkjet printer includes a printer body and at least one spray head arranged on the printer body. The spray head is used to print target images and texts on the printing medium. For example, in some embodiments, at least one spray head includes a first spray head, a second spray head, a third spray head and a fourth spray head; wherein the first spray head is used for printing cyan ink (Cyan, C), the second spray head is used for printing magenta ink (Magenta, M), the third spray head is used for printing yellow ink (Yellow, Y), and the fourth spray head is used for printing black ink (BlacK, K). C, M, Y and K are four basic colors, and the inkjet printer produces the required colors by controlling each spray head in the spray head group to print different doses of ink. The first spray head, the second spray head, the third spray head and the fourth spray head may be single spray head units or formed by combining a plurality of spray head units. In some embodiments, the inkjet printer further includes an $N_{th}$ spray head (N is a positive integer greater than 4) for printing other colors of ink; for example, a spray head group 120 may further include spray heads for printing white ink, golden ink, sapphire blue ink or silver ink.

Figure 1:
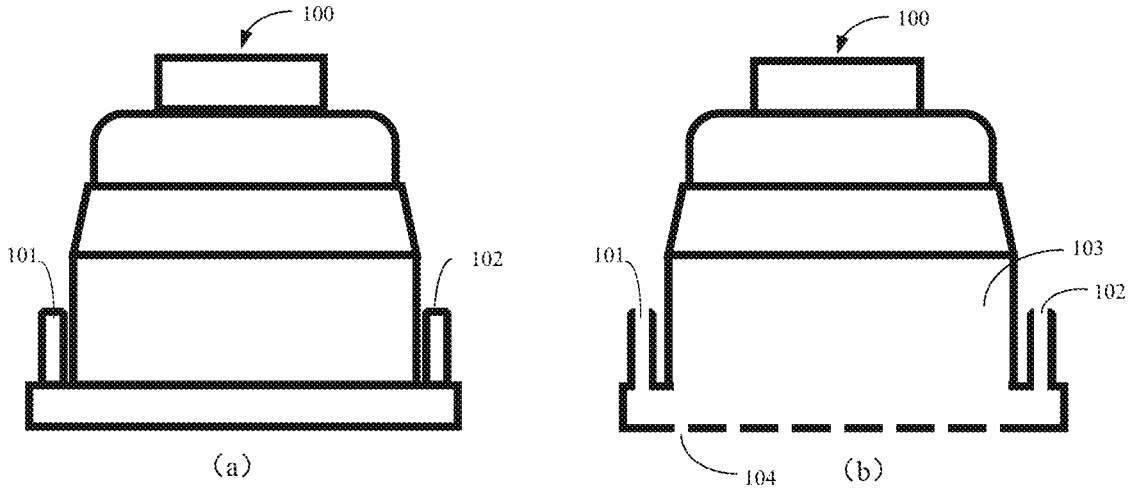
FIG. 1 is a schematic structural diagram of a spray head of an inkjet printer according to an embodiment of the present application, wherein (a) and (b) are the different visual angle of the spray head.

By way of example, FIG. 1 show schematic structural diagrams of a spray head viewed from different perspectives; wherein (a) is a front view and (b) is a cross-sectional view. As shown in FIG. 1, a spray head 100 includes a liquid inlet 101, a liquid outlet 102, an ink cavity 103 and a plurality of spray holes 104, wherein the ink cavity 103 is in communication with the external environment through the spray holes 104, and the ink cavity 103 is used for containing ink for printing target images and texts. When the inkjet printer performs printing jobs, ink flows into the ink cavity 103 from the liquid inlet 101, and part of the ink in the ink cavity 103 flows out from the liquid outlet 102, while the other part is ejected through the spray holes 104; wherein the ink ejected from the spray holes 104 forms target images and texts on the printing medium, and the ink flowing out from the liquid outlet 102 can flow into the ink cavity 103 again through the ink circulation pipeline of the inkjet printer. In some other embodiments, the spray head may further include components such as a filtering layer and a drainage channel (not shown), and the ink flowing in from the liquid inlet of the spray head passes through the ink cavity, the filtering layer and the drainage channel in sequence and is ejected from the spray holes.

When the inkjet printer is used or not used for a long time, the ink in the spray head of the inkjet printer is likely to get dried, agglomerated or even solidified into ink dregs inside the spray head, which results in blockage of the spray holes. In the past, in order to dredge the spray head, usually it is necessary to clean the inside of the spray head by using cleaning liquid. For example, the cleaning liquid may specifically include components such as water and organic solvents. When cleaning the spray head, the nozzle of the spray head may be placed face down so that the liquid inlet of the spray head is in an unblocked state and the liquid outlet of the spray head is in a blocked state, then the cleaning liquid is injected into the spray head from the liquid inlet of the spray head through a liquid supply pump, and the cleaning liquid is finally ejected from the spray holes, thereby completing the cleaning and maintenance of the spray head. When the spray head further includes a filtering layer and a drainage channel, the cleaning liquid injected by the liquid supply pump from the liquid inlet of the spray head passes through the ink cavity, the filtering layer and the drainage channel of the spray head in sequence and is finally ejected from the spray holes, thereby completing the cleaning of the spray head. However, if the liquid supply pump directly pumps the cleaning liquid into the spray head, the impact force generated by the cleaning liquid will damage the delicate structure inside the spray head, which results in the damage of the spray head. For example, the filtering accuracy of the filtering layer is high, and the ink dregs are easily attached to the filtering layer under the driving of the cleaning liquid and thus block the filtering layer; or the ink dregs will forcibly pass through the filtering layer under the pressure of the cleaning liquid so that the filtering layer is damaged, and thus the filtering effect of the filtering layer on the ink in subsequent printing cannot be guaranteed, and the printing quality is compromised.

In view of this, an embodiment of the present application provides a maintenance system for the spray head, which can dredge the spray head through the ink oscillating in the ink cavity of the spray head, and through which the impact force of the ink on the spray head is small. In order to facilitate the appreciation of the present application by readers, the following description will be made with reference to specific embodiments.

Figure 2:
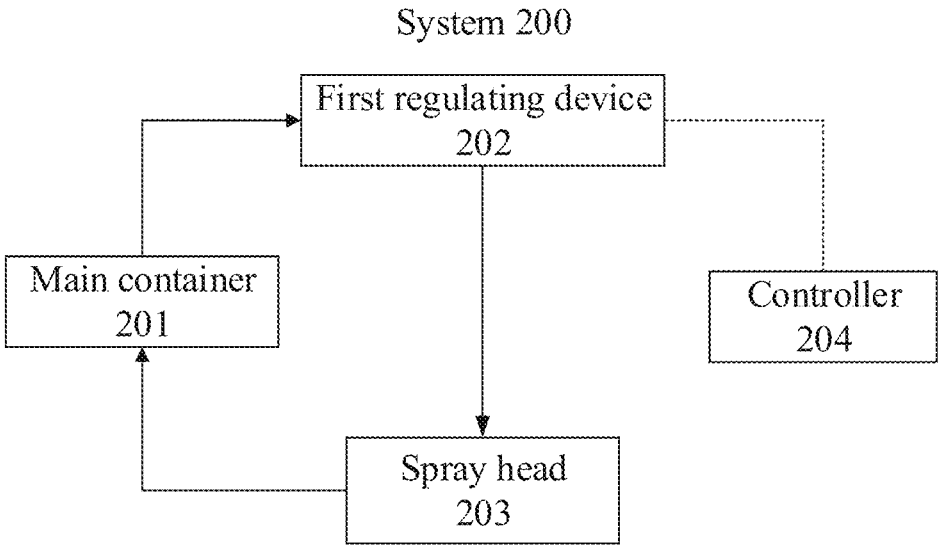
FIG. 2 is a schematic structural diagram of a maintenance system for a spray head according to an embodiment of the present application.

By way of example, FIG. 2 shows a maintenance system for a spray head, the system is used to dredge the spray head of an inkjet printer, and the system includes a controller and an ink circulation loop; as shown in FIG. 2, the ink circulation loop of the system 200 includes a main container 201, a first regulating device 202 and a spray head 203 which are arranged in sequence along the ink delivery direction (i.e., the direction indicated by the arrow in FIG. 2), wherein the first regulating device 202 is respectively connected with the main container 201 and the spray head 203 through pipelines, and the spray head 203 is connected with the main container 201 through a pipeline. Specifically, the liquid outlet of the main container 201 is connected with the liquid inlet of the first regulating device 202 through a pipeline, the liquid outlet of the main container 201 is connected with the liquid inlet of the spray head 203 through a pipeline, and the liquid inlet of the spray head 203 is connected with the liquid outlet of the first regulating device 202 through a pipeline. The main container 201 is used to store ink, and it may provide an ink source for the system 200.

The system 200 further includes a controller 204, which is communicatively connected with the first regulating device 202 by for example wired connection or Wireless Fidelity technology (Wi-Fi), Bluetooth (BT) technology, frequency modulation (FM), near field communication technology (NFC), infrared technology (IR), or wireless connection realized by mobile communication technologies such as 3rd Generation (3G), 4th Generation (4G) or 5th Generation (5G).

The first regulating device 202 includes a first accommodating cavity for storing first gas and ink flowing in from the main container 201, and the first regulating device 202 is configured to regulate the pressure of the first gas, i.e., the first air pressure; the spray head 203 may be the spray head shown in FIG. 1, and the ink cavity of the spray head 203 is connected with the first accommodating cavity and the main container 201 through pipelines. When the ink in the ink circulation loop is in a circulating flow state, the ink flowing out of the main container 201 flows through the first regulating device 202 and the spray head 203 successively, and then flows back to the main container 201.

The controller 204 is used to control the first air pressure to change within the first negative pressure range through the first regulating device 202 when the ink in the ink circulation loop is in a circulating flow state, so as to make the ink in the ink cavity oscillate, wherein the oscillation direction of the ink includes the length direction of the spray holes. For example, in some embodiments of the present application, the circulating flow direction of ink in the ink cavity may be a horizontal direction, and the length direction of the spray holes may be a vertical direction, wherein both the horizontal direction and the vertical direction may be defined relative to the ground.

In the system, the first air pressure changing within the first negative pressure range will cause the ink in the ink cavity to oscillate; the constantly oscillating ink in the ink cavity can make the ink that has agglomerated and adhered in the ink cavity and the spray holes and solidified into dregs fall off and break up by vibration, and the ink dregs that are fallen and broken into smaller pieces can be discharged out of the ink cavity along with the ink flowing out from the liquid outlet of the spray head and then reused after subsequent filtering processing, thereby realizing the maintenance of the spray holes. On the one hand, the constantly oscillating ink in the ink cavity will not generate a great impact force on the spray head, and forced passage of the ink through the spray head is not required, thereby reducing the impact force on the spray head caused by dredging the spray head; on the other hand, the method can dredge the spray head through ink, without using additional cleaning liquid to clean the spray head, and without disassembling the spray head from the inkjet printer for cleaning, thereby effectively simplifying the cleaning process of the spray head and improving the dredging efficiency of the spray head.

Figure 3:
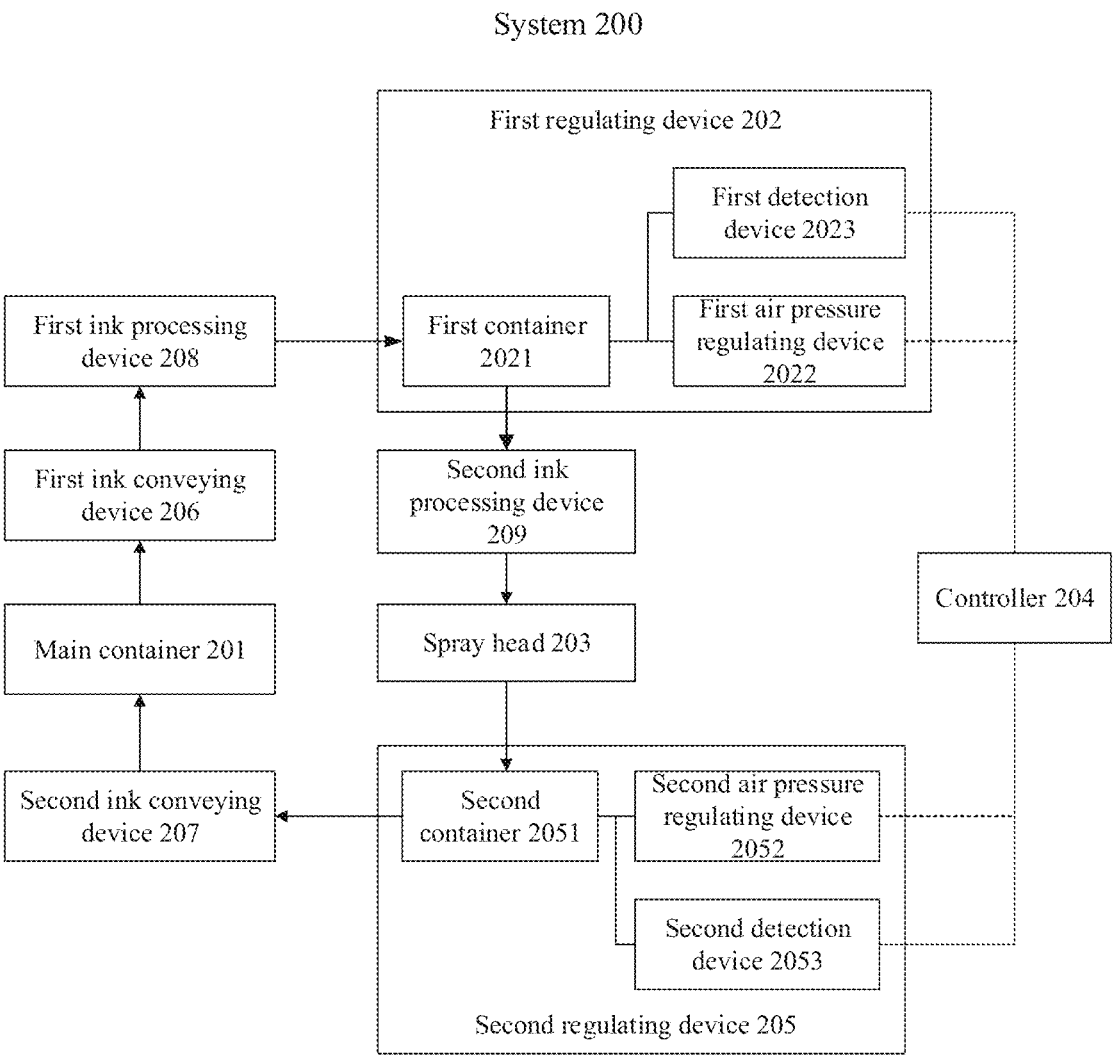
FIG. 3 is a schematic structural diagram of a maintenance system for a spray head according to another embodiment of the present application.

Referring to FIG. 3, in some embodiments, the first regulating device 202 includes a first container 2021, a first air pressure regulating device 2022 and a first detection device 2023; wherein the first air pressure regulating device 2022 and the first detection device 2023 are respectively communicatively connected with the controller 204. The first container 2021 is opened with a liquid inlet, a liquid outlet and a gas delivery port. The liquid inlet of the first container 2021 is connected with the liquid outlet of the main container 201 through a pipeline, and the liquid outlet of the first container 2021 is connected with the liquid inlet of the spray head 203 through a pipeline. The first air pressure regulating device 2022 is connected with the gas delivery port of the first container 2021 through a pipeline.

The first container 2021 is used to contain the first gas and ink, and the first container includes a first accommodating cavity. In some possible embodiments, the lower space of the first container 2021 is used to contain ink, while the upper space of the first container 2021 is used to contain the first gas. The liquid inlet and the liquid outlet of the first container 2021 may be opened below the liquid level of the ink in the first container 2021, and the gas delivery port of the first container 2021 may be opened above the liquid level of the ink in the first container 2021.

The first air pressure regulating device 2022 is used to regulate the pressure of the first gas in the first container 2021, i.e., the first air pressure. The first detection device 2023 is arranged in the gas containing space of the first container 2021, or the first detection device 2021 is arranged in a pipe connecting the first container 2021 and the first air pressure regulating device 2022. The first detection device 2023 is used to measure the first air pressure. The controller 204 may communicate with the first detection device and obtain detection data of the first air pressure through the first detection device 2023. The controller 204 can control the first air pressure to change within the first negative pressure range through the first air pressure regulating device 2022 according to the detection data of the first air pressure.

As shown in FIG. 3, in some embodiments, the ink circulation loop further includes a second regulating device 205, which is respectively connected with the spray head and the main container 201 through pipelines; that is, the liquid inlet of the second regulating device 205 is connected with the liquid outlet of the spray head 203 through a pipeline, and the liquid outlet of the second regulating device 205 is connected with the liquid inlet of the main container 201 through a pipeline. The second regulating device 205 includes a second accommodating cavity for storing second gas and ink flowing in from the spray head 203, and the second regulating device 205 is configured to regulate the pressure of the second gas, i.e., the second air pressure. The first gas and the second gas may be any suitable gas, for example, air. The controller 204 controls the second air pressure to change within the second negative pressure range through the second regulating device 205 so that the negative pressure in the second accommodating cavity is greater than the negative pressure in the first accommodating cavity; wherein the first air pressure and the second air pressure change in the same preset period. When the first air pressure and the second air pressure change in the same preset period, the difference between the first air pressure and the second air pressure is within a preset difference range.

Referring to FIG. 3, in some embodiments, the second regulating device 205 includes a second container 2051, a second air pressure regulating device 2052 and a second detection device 2053; wherein he second air pressure regulating device 2052 and the second detection device 2053 are respectively communicatively connected with the controller 204. The second container 2051 is opened with a liquid inlet, a liquid outlet and a gas delivery port. The liquid inlet of the second container 2051 is connected with the liquid outlet of the spray head 203 through a pipeline, and the liquid outlet of the second container 2051 is connected with the liquid inlet of the main container 201 through a pipeline. The second air pressure regulating device 2052 is connected with the gas delivery port of the second container 2051 through a pipeline.

The second container 2051 is used to contain second gas and ink, and the second container 2051 includes a second accommodating cavity. In some possible embodiments, the lower space of the second container 2051 is used to contain the ink, while the upper space of the second container 2051 is used to contain the second gas. The liquid inlet and the liquid outlet of the second container 2051 may be opened below the liquid level of the ink in the second container 2051, while the gas delivery port of the second container 2051 may be opened above the liquid level of the ink in the second container 2051.

The second air pressure regulating device 2052 is used to regulate the pressure of the gas in the second container 2051, i.e., the second air pressure. The second detection device 2053 is arranged in the gas containing space of the second container 2051, or the second detection device 2053 is arranged in a pipe connecting the second container 2051 and the second air pressure regulating device 2052. The second detection device 2052 is used to measure the second air pressure. The controller 204 may communicate with the second detection device 2053, and acquire detection data of the second air pressure obtained by measuring the second air pressure by the second detection device 2053. The controller 204 is used to control the second air pressure to change within the second negative pressure range through the second air pressure regulating device 2052 according to the detected data of the second air pressure.

Specifically, the first detection device 2023 and the second detection device 2053 are air pressure detection devices; the first air pressure regulating device 2022 and the second air pressure regulating device 2052 reduce or increase the air pressure in a container (for example, the first container 2021 or the second container 2051) by removing air from or adding air into the container. Generally, the storage capacity of ink for the main container is larger than that of the first container, and the storage capacity of ink for the main container is also larger than that of the second container; and for example, the main container is an ink barrel, the first container is a secondary ink cartridge, and the second container is a reflow box.

In some embodiments, the controller 204 controls the second air pressure to change within the second negative pressure range through the second regulating device 205 so that the negative pressure in the second accommodating cavity is greater than the negative pressure in the first accommodating cavity; wherein the first air pressure and the second air pressure change in the same preset period. When the first air pressure and the second air pressure change in the same preset period, the difference between the first air pressure and the second air pressure is within the preset difference range. The first air pressure and the second air pressure change in a preset period of 1 to 4 seconds which may be specifically set according to actual conditions; for example, the first air pressure and the second air pressure may change in a preset period of 1 second, 1.5 seconds, 2 seconds, 2.5 seconds and 3 seconds.

Referring to FIG. 3, in some embodiments, the ink circulation loop of the system 200 further includes a first ink conveying device 206, which is respectively connected with the main container 201 and the first container 2021 through pipelines to provide power for ink flow. Specifically, the liquid inlet of the first ink conveying device 206 is connected with the liquid outlet of the main container 201 through a pipeline, and the liquid outlet of the first ink conveying device 206 is connected with the liquid inlet of the first container 2021. The first ink conveying device 206 is used to convey the ink in the main container 201 to the first container 2021. The first ink delivery device 206 may be specifically an infusion pump, such as a peristaltic pump. The direction indicated by the arrow in FIG. 3 is the circulating delivery direction of ink.

Referring to FIG. 3, in some embodiments, the ink circulation loop of the system 200 further includes a second ink conveying device 207, the liquid inlet of the second ink conveying device 207 is connected with the liquid outlet of the second container 2051, the liquid outlet of the second ink conveying device 207 is connected with the liquid inlet of the main container 201, and the second ink conveying device 207 is configured to convey the ink in the second container 2051 to the main container 201. The second ink delivery device 207 may be specifically an infusion pump, for example, a peristaltic pump.

Referring to FIG. 3, in some embodiments, the ink circulation loop of the system 200 further includes a first ink processing device 208, the liquid outlet of the first ink processing device 208 is connected with the liquid inlet of the first container 2021 through a pipeline, and the liquid inlet of the first ink processing device 208 is connected with the liquid inlet of the first ink conveying device 206 through a pipeline. The first ink processing device 208 is used to purify the ink and then deliver the ink purified to the first container 2021. The first ink processing device 208 may include a first filter for removing bubbles and impurities in the ink flowing into the first container 2021.

Referring to FIG. 3, in some embodiments, the ink circulation loop of the system 200 further includes a second ink processing device 209, the liquid inlet of the second ink processing device 209 is connected with the liquid outlet of the first container 2021 through a pipeline, and the liquid outlet of the second ink processing device 209 is connected with the liquid inlet of the spray head 203 through a pipeline. The second ink processing device 209 is used to purify the inflowing ink and convey the ink processed to the spray head 203. The purifying processing includes filtering processing, and for example, the second ink processing device 209 may include a degassing device and/or a second filter.

It shall be noted that, the components shown in FIG. 2 and FIG. 3 do not constitute a specific limitation on the system 200, and the system 200 may further include more or less components than those shown in the figures, or some components may be combined, or some components may be split, or different components may be arranged. In addition, the combination/connection relationships among the components in FIG. 2 and FIG. 3 may also be adjusted and modified.

When the ink in the ink circulation loop is in a circulating flow state, the controller 204 controls the first air pressure to change within the first negative pressure range through the first regulating device 202 to make the ink in the ink cavity oscillate, wherein the oscillation direction of the ink includes the length direction of the spray holes 203. In some embodiments, the length direction of the spray holes 203 is the axis direction of the spray holes 203. When the ink in the ink circulation loop is in a circulating flow state, the ink flows into the ink cavity of the spray head from the first accommodating cavity; because the first accommodating cavity and the ink cavity of the spray head are in a communication state, the change of the first air pressure within the first negative pressure range can make the ink in the first accommodating cavity and the ink cavity of the spray head oscillate at the same time; the constantly oscillating ink in the ink cavity can make the ink that has agglomerated and adhered in the ink cavity and the spray holes and solidified into dregs fall off and break up by vibration, and the ink dregs that are fallen and broken into smaller pieces can be discharged to the main container along with the ink flowing out from the liquid outlet of the spray head and then reused after subsequent filtering processing, thereby realizing the dredging and maintenance of the spray holes. On the one hand, the constantly oscillating ink in the ink cavity will not generate a great impact force on the spray head, and forced passage of the ink through the spray head is not required, thereby reducing the impact force on the spray head caused by dredging the spray head; on the other hand, the system can dredge the spray head through ink, without using additional cleaning liquid to clean the spray head, and without disassembling the spray head from the inkjet printer for cleaning, thereby effectively simplifying the cleaning process of the spray head and improving the dredging efficiency of the spray head.

In some embodiments, the first negative pressure range includes a first maximum value and a first minimum value of the first air pressure. The controller 204 controls the first air pressure to change between the first maximum value and the first minimum value through the first regulating device 202 so that the position of the liquid level formed by the ink in the ink cavity and the spray holes correspondingly changes between the first position and the second position; wherein the second position is far away from the ink cavity relative to the first position. Specifically, the first air pressure may periodically change within the first negative pressure range according to a preset period, so that the ink in the ink cavity periodically oscillates. The oscillation period of the periodical oscillation of ink is the same as the change period of the first air pressure and the second air pressure, which may be specifically set according to the actual conditions to be for example 1 second, 1.5 seconds, 2 seconds, 2.5 seconds, 3 seconds or the like. The duration of periodical oscillation of ink may be set as required to be for example 20 seconds, 30 seconds, 60 seconds, 100 seconds or the like.

Figure 4:
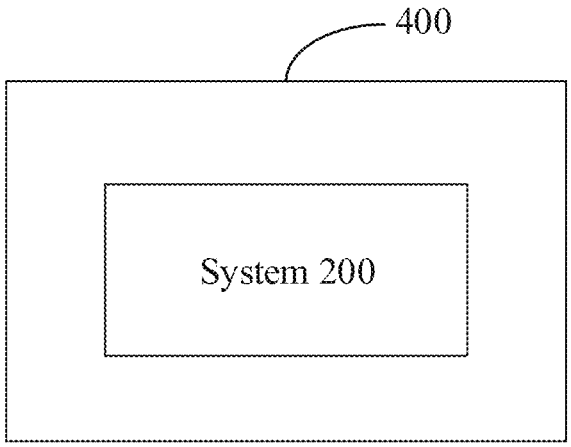
FIG. 4 is a schematic structural diagram of an inkjet printer according to an embodiment of the present application.

An embodiment of the present application further provides an inkjet printer, which includes the maintenance system for the spray head provided according to the above embodiment. As shown in FIG. 4, the inkjet printer 400 may include the system 200 in FIG. 2 or FIG. 3. The inkjet printer can maintain the spray head by itself, without disassembling the spray head and using other cleaning devices to clean the spray head, thereby effectively simplifying the dredging process of the spray head and improving the dredging efficiency of the spray head.

Figure 5:
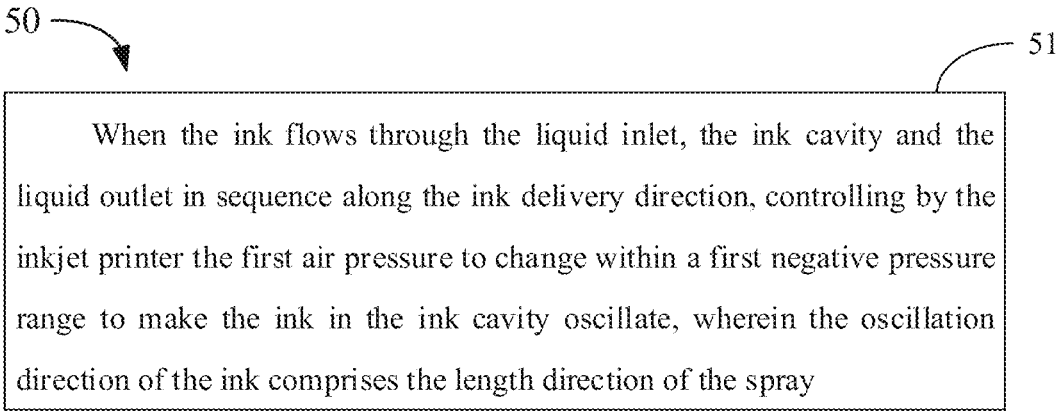
FIG. 5 is a schematic flowchart diagram of a cleaning method for a spray head according to an embodiment of the present application.

An embodiment of the present application further provides a maintenance method for the spray head, the method may be applied to the maintenance system for the spray head provided according to the above embodiment, and it may also be applied to an inkjet printer; wherein in some embodiments of the present application, the inkjet printer may be the inkjet printer in FIG. 4. This method is used to maintain the spray head of the inkjet printer, and for example, the spray head may be specifically the spray head in FIG. 1; FIG. 5 schematically shows a process flow 50 of the maintenance method for the spray head, and as shown in FIG. 5, the process flow 50 of the method includes the following steps:

step 51: when the ink flows through the liquid inlet, the ink cavity and the liquid outlet in sequence along the ink delivery direction, applying a first air pressure to the ink in the ink cavity at the end of the liquid inlet of the spray head and controlling the first air pressure to change within a first negative pressure range to make the ink in the ink cavity oscillate, wherein the oscillation direction of the ink includes the length direction of the spray holes.

In this embodiment, the inkjet printer may control the ink to flow through the liquid inlet, the ink cavity and the liquid outlet in sequence along the ink delivery direction, and during the ink delivery process, the air pressure of the inkjet printer at the end of the liquid inlet of the spray head is the first air pressure, and the inkjet printer controls the first air pressure to change within the first negative pressure range to make the ink in the ink cavity oscillate, wherein the oscillation direction of the ink includes the length direction of the spray holes. For example, the ink level at the end of the liquid inlet of the spray head is in contact with the first gas, and the pressure of the first gas is the first air pressure.

Specifically, the first negative pressure range includes the first maximum value and the first minimum value of the first air pressure. For example, if the first negative pressure range is 0.3 to 9.0 kpa, then the maximum value and the minimum value of the first air pressure are 0.3 kpa and 9.0 kpa respectively. When the first air pressure is the first maximum value, the position of the liquid level formed by the ink in the ink cavity and the spray holes is located at the first position; and when the first air pressure is the first minimum value, the position of the liquid level formed by the ink in the ink cavity and the spray holes is located at the second position; wherein the second position is far away from the ink cavity relative to the first position. The first air pressure periodically changes within the first negative pressure range according to a preset period so that the ink in the ink cavity periodically oscillates.

Figure 6:
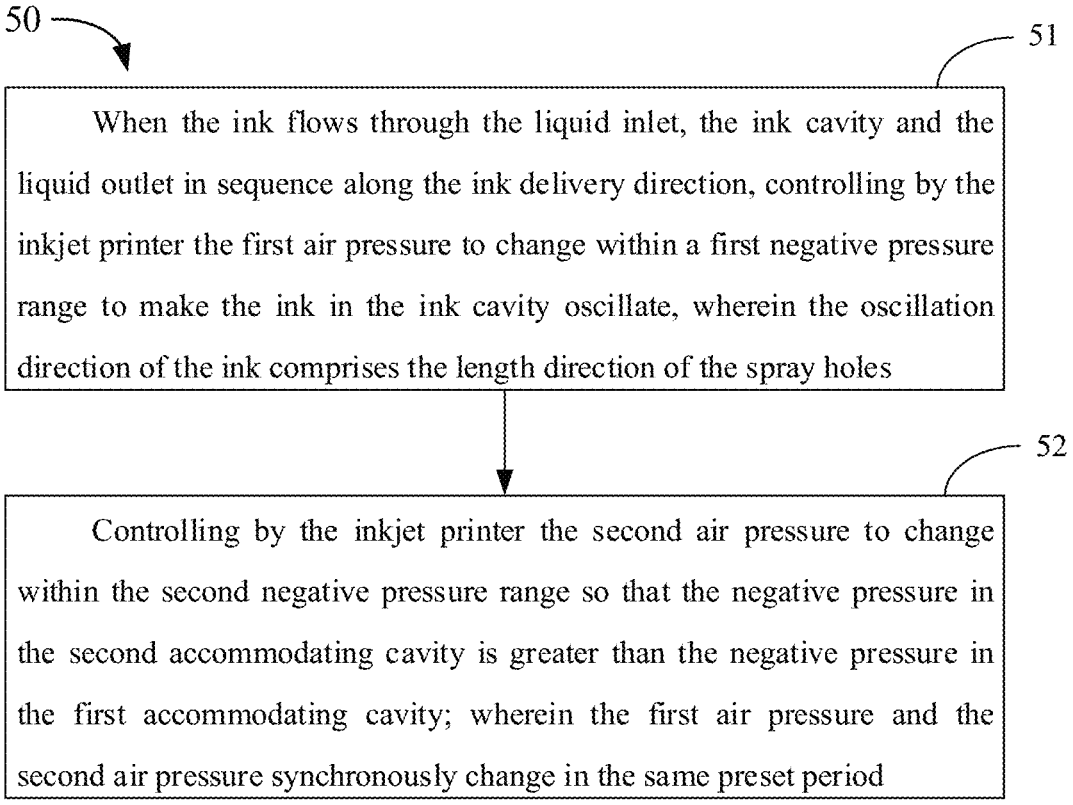
FIG. 6 is a schematic flowchart diagram of a cleaning method for a spray head according to another embodiment of the present application.

Referring to FIG. 6, in some embodiments, the method described above further includes the following steps:

step 52: the air pressure at the end of the liquid outlet of the spray head being the second air pressure, controlling the second air pressure to change within the second negative pressure range by the inkjet printer so that the negative pressure at the end of the liquid outlet is greater than the negative pressure at the end of the liquid inlet; wherein the first air pressure and the second air pressure change in the same preset period.

In this embodiment, the ink level at the end of the liquid outlet of the spray head is in contact with the second gas, and the pressure of the second gas is the second air pressure. In some embodiments, the second air pressure at the end of the liquid outlet may be kept constant. In some other embodiments, in order to make the ink flow through the spray head more smoothly, the inkjet printer may control the second air pressure to change within the second negative pressure range so that the negative pressure at the end of the liquid outlet is greater than the negative pressure at the end of the liquid inlet. In the embodiment of the present application, both the air pressure in the first negative pressure range and the air pressure in the second negative pressure range are negative pressures, and the negative pressure is a gas pressure state lower than the normal pressure (i.e., one atmospheric pressure that is commonly known). That is, both the first air pressure in the first negative pressure range and the air pressure in the second negative pressure range are less than 1 atm. For example, the first negative pressure range may be 0.3 to 9.0 kpa, and the second negative pressure range may be specifically 0.6 to 9.3 kpa. The first negative pressure range and the second negative pressure range may also be any other suitable negative pressure ranges.

When the first air pressure and the second air pressure change in the same preset period, the air pressure difference between the first air pressure and the second air pressure is within the preset difference range so that the flow rate of ink in the ink cavity may be stabilized. The second negative pressure range includes the second maximum value and the second minimum value of the second air pressure; when the second air pressure is the second maximum value, the liquid level formed by the ink in the ink cavity and the spray holes is located at the first position; when the second air pressure is the second minimum value, the liquid level formed by the ink in the ink cavity and the spray holes is located at the second position; wherein the second position is far away from the ink cavity relative to the first position.

The second negative pressure range includes the maximum value and the minimum value of the second air pressure. In some embodiments of the present application, the first air pressure and the second air pressure change synchronously in the same change period. When the first air pressure is the maximum value, the second air pressure is also the maximum value; when the first air pressure is the minimum value, the second air pressure is also the minimum value. For example, when the first negative pressure is 0.3 kpa, the second negative pressure is 0.6 kpa; when the first negative pressure is 9.0 kpa, the second negative pressure is 9.3 kpa. The change periods of the first air pressure and the second air pressure are the same. In some embodiments, when the first air pressure and the second air pressure change synchronously in the same change period, the pressure difference between the first air pressure and the second air pressure is within the preset pressure difference range. For example, the preset pressure difference range may be 0.25 to 0.35 kpa or about 0.3 kpa.

On the one hand, because the negative pressure at the end of the liquid outlet is greater than the negative pressure at the end of the liquid inlet, the pressure difference between the end of the liquid inlet and the end of the liquid outlet provides a guiding force for the ink to flow from the liquid inlet of the spray head to the ink cavity and the liquid outlet of the spray head in sequence; on the other hand, because the first air pressure and the second air pressure change synchronously and repeatedly within their respective negative pressure ranges in the same change period, the ink in the ink cavity can oscillate constantly in the ink cavity, and the constantly oscillating ink in the ink cavity and the spray holes can make the ink that has agglomerated and adhered in the ink cavity and the spray holes and solidified into dregs fall off and break up by vibration and discharged from the liquid outlet, thereby realizing the cleaning of the spray holes. The constantly oscillating ink will not generate a great impact force on the spray head, and forced passage of the ink through the spray head is not required, thereby reducing the impact force on the spray head caused by cleaning the spray head.

The inkjet printer may regulate the first air pressure and the second air pressure to the maximum value at the same time so that the liquid level formed by the ink in the ink cavity and the spray holes is located at the first position. The inkjet printer may also regulate the first air pressure and the second air pressure to the minimum value at the same time so that the liquid level formed by the ink in the ink cavity and the spray holes is located at the second position; wherein the second position is far away from the ink cavity relative to the first position. The maintenance of the spray holes is completed by the oscillation of the ink in the spray holes, and the ink will not forcibly pass through the spray holes, so that the damage to the spray holes caused by cleaning the spray holes can be reduced. At the same time, since the ink in the spray holes oscillates between the first position and the second position, the ink will not flow out of the spray holes, thereby reducing the waste of ink.

Figure 7:
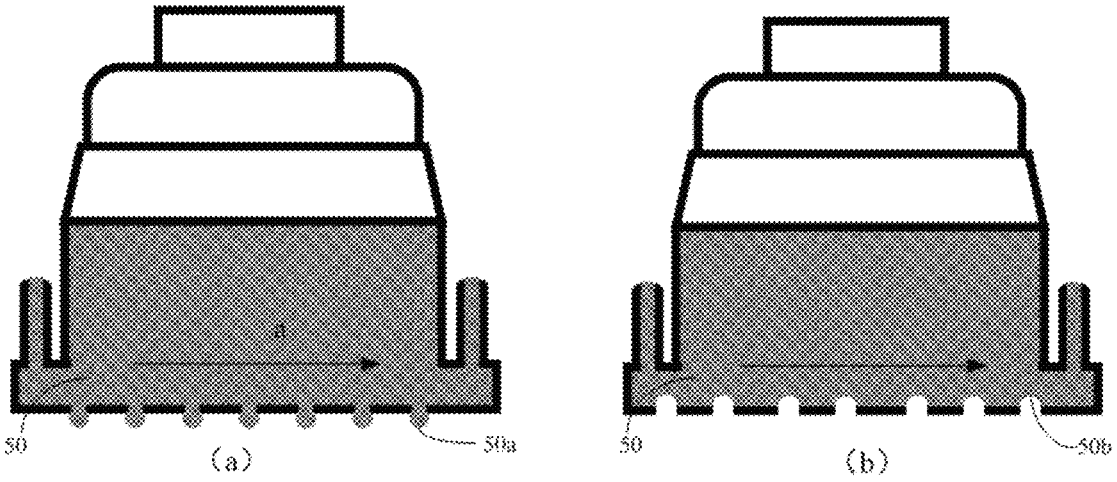
FIG. 7 is a schematic view illustrating different states of ink in an ink cavity in the process of oscillation according to an embodiment of the present application.

FIG. 7 exemplarily show different states of ink oscillating in the ink cavity, wherein the direction indicated by arrow a is the first direction, which is also the circulating flow direction of the ink in the ink cavity. As shown in part (a) of FIG. 7, the position of the liquid level formed by the spray holes and the ink is located at a second position 50*a*; as shown in part (a) of FIG. 7, part of the ink 50 in the ink cavity forms droplets on the side of the spray holes away from the ink cavity, and the droplets hang at the outside of the spray holes and are in a state of non-dripping. As shown in part (b) of FIG. 7, the position of the liquid level formed by the spray holes and the ink is located at a first position 50*b*. The first position and the second position are respectively located at both sides of the spray holes. Moreover, the liquid level at the second position is a convex liquid level, while the liquid level at the first position is a concave liquid level. As the ink in the ink cavity can change between the first position and the second position, the ink can oscillate back and forth through the spray holes without forcibly passing through the spray holes, thereby effectively reducing the impact force of the ink on the spray head.

For example, in some embodiments, part (a) of FIG. 7 shows the state of ink in the ink cavity when the first air pressure and the second air pressure are both minimum values; at this time, the liquid level formed by the ink 50 in the ink cavity and the spray holes is located at the second position 50*a*. Part (b) of FIG. 7 shows the state of the ink 50 in the ink cavity when the first air pressure and the second air pressure are both maximum values; at this time, the liquid level formed by the ink 50 in the ink cavity and the spray holes is located at the first position 50*b*. As shown in part (b) of FIG. 7, when the first air pressure and the second air pressure are both maximum values, the position of the liquid level in the spray holes is located at the first position 50*b*, and the ink in the ink cavity and the spray holes form a concave liquid level which is located in the ink cavity.

Figure 8:
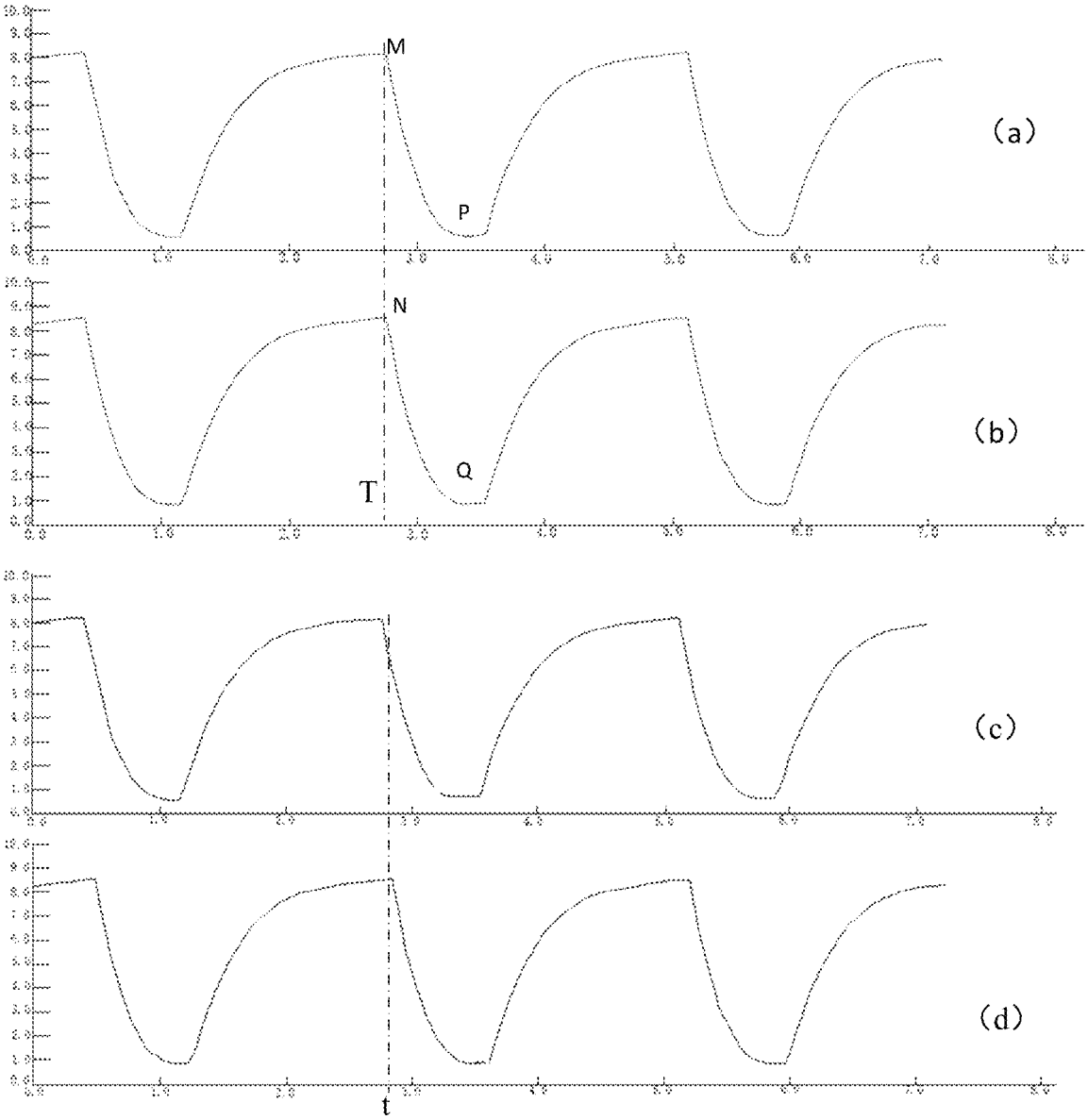
FIG. 8 is a curve chart illustrating the synchronous change of the first air pressure and the second air pressure with time; wherein (a) is the curve chart of the first air pressure according to an embodiment of the present application; (b) is the curve chart of the second air pressure according to an embodiment of the present application; (c) is the curve chart of the first air pressure according to another embodiment of the present application; (d) is the curve chart of the second air pressure according to another embodiment of the present application.

By way of example, FIG. 8 respectively illustrating the synchronous change of the first air pressure and the second air pressure with time, wherein the curve (a) is the change curve of the first air pressure and the curve (b) is the change curve of the second air pressure. The first air pressure fluctuates between 0.5 and 8.1 kpa in a change period of 2.5 s; the second air pressure fluctuates between 0.8 and 8.4 kpa, and the change period of the second air pressure is the same as the change period of the first air pressure. When the negative pressure values of the first air pressure and the second air pressure are at the maximum values at the same time, for example, at points M and N in FIG. 8, the inkjet printer may lower the negative pressure values of the first air pressure and the second air pressure by filling gas into the first accommodating cavity and the second accommodating cavity. When the negative pressure values of the first air pressure and the second air pressure are at minimum values at the same time, for example, at points P and Q in FIG. 8, the inkjet printer may raise the negative pressure values of the first air pressure and the second air pressure by discharging the gas in the first accommodating cavity and the second accommodating cavity.

In some other embodiments of the present application, the first air pressure and the second air pressure may also change asynchronously. Please refer to curve (c) and curve (d) in FIG. 8, wherein curve (c) is the change curve of the first air pressure, and curve (d) is the change curve of the second air pressure. In the same change period, the first air pressure reaches the maximum value before the second air pressure, that is, the first air pressure changes earlier than the second air pressure. For example, at time t, the second air pressure reached the maximum value, but the first air pressure has not reached the maximum value, and it is assumed that the difference obtained by subtracting the first air pressure from the second air pressure at time t is H. In contrast, in curve (a) and curve (b), at time T, the first air pressure and the second air pressure reached the maximum value at the same time, the difference obtained by subtracting the first air pressure from the second air pressure at time T is set to be L, and then H>L. When the second air pressure is the maximum value, the larger the difference obtained by subtracting the first air pressure from the second air pressure is, the more violent the instant oscillation of the ink in the ink cavity will be, and the better the dredging effect of the spray head will be. In some embodiments of the present application, when the first air pressure changes behind the second air pressure, the dredging effect of ink on the spray head can also meet the use requirements. The difference between the change time of the first air pressure and the second air pressure may be set as required to be for example 0.1 second, 0.2 second or the like. In FIG. 8, the X axis is the time axis in seconds, and the Y axis is the negative pressure axis in kpa.

Figure 9:
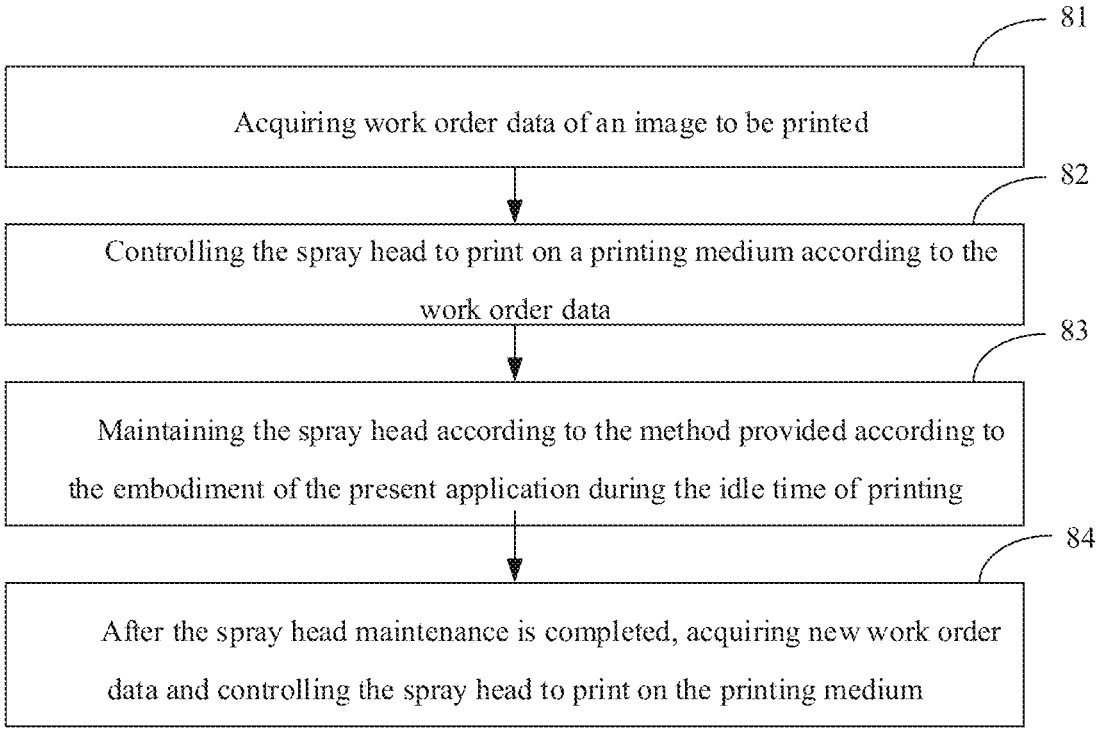
FIG. 9 is a schematic flowchart diagram of a printing method according to an embodiment of the present application.

An embodiment of the present application further provides a printing method applied to an inkjet printer, referring to FIG. 9, the method includes the following steps:

step 81: acquiring work order data of an image to be printed;

step 82: controlling the spray head to print on a printing medium according to the work order data;

step 83: maintaining the spray head according to the maintenance method for the spray head provided according to the above embodiment during the idle time of printing;

step 84: after the spray head maintenance is completed, acquiring new work order data and controlling the spray head to print on the printing medium.

In this embodiment, the inkjet printer can not only print target images and texts with ink, but also dredge and maintain the spray head with ink. The inkjet printer does not need to use additional cleaning liquid to dredge the spray head. The working mode of the inkjet printer may specifically include a printing mode and a maintenance mode. In the printing mode, the ink inlet of the spray head inputs the ink into the ink cavity, and among the ink flowing through the ink cavity, part of the ink is ejected from the spray holes to form ink droplets and form printed patterns on the printing medium; the other part of the ink flows out from the liquid outlet of the spray head and finally flows back to the main container. In the maintenance mode, the controller regulates the value of the first air pressure at the input end of the spray head so that the ink in the ink cavity flows out from the liquid outlet of the spray head along the first direction, and meanwhile oscillates along the second direction. The first direction is the circulating flow direction of the ink in the ink cavity, and the second direction includes the length direction of the spray holes.

The inkjet printer may specifically acquire work order data of an image to be printed and control the spray head to print on a printing medium according to the work order data, and during the idle time of printing, the inkjet printer maintains the spray head according to the maintenance method for the spray head provided according to the above embodiment, wherein the idle time of printing includes the interval time between printing different work order data. The idle time of printing may further include the time after the inkjet printer stops printing jobs. After the spray head maintenance is completed, new work order data is acquired and the spray head is controlled to print on the printing medium.

Figure 10:
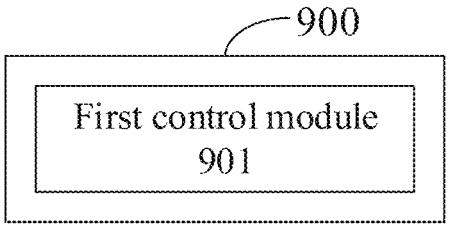
FIG. 10 is a schematic structural diagram of a cleaning device for a spray head according to an embodiment of the present application.

An embodiment of the present application further provides a maintenance device for a spray head which is applied to an inkjet printer, the spray head includes a liquid inlet, a liquid outlet, an ink cavity and a plurality of spray holes, wherein one end of the ink cavity is in communication with the liquid inlet, the other end of the ink cavity is in communication with the liquid outlet, the ink cavity is in communication with the external environment through the spray holes, the surface of the ink at the end of the liquid inlet of the spray head is in contact with a first gas, and the pressure of the first gas is the first gas pressure. Referring to FIG. 10, the device 900 includes a first control module 901, and the first control module 901 is used to control the first air pressure to change within a first negative pressure range when the ink flows through the liquid inlet, the ink cavity and the liquid outlet in sequence along the ink delivery direction, so as to make the ink in the ink cavity oscillate, wherein the oscillation direction of the ink includes the length direction of the spray holes.

In some embodiments, the first negative pressure range includes a first maximum value and a first minimum value of the first air pressure; the first control module 901 is specifically configured to: control the first air pressure to change between the first maximum value and the first minimum value so that the position of the liquid level formed by the ink in the ink cavity and the spray holes correspondingly changes between the first position and the second position; wherein the second position is far away from the ink cavity relative to the first position.

In some embodiments, the first control module 901 is specifically configured to: control the first air pressure to change periodically within the first negative pressure range according to a preset period so that the ink in the ink cavity oscillates periodically.

Figure 11:
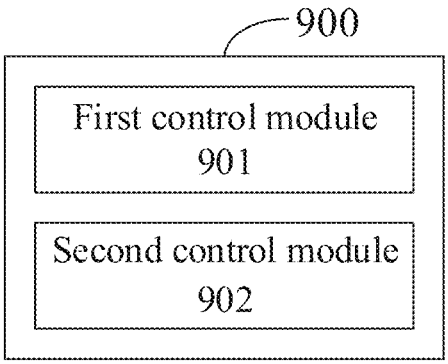
FIG. 11 is a schematic structural diagram of a cleaning device for a spray head according to another embodiment of the present application.

Referring to FIG. 11, in some embodiments, the liquid level of the ink at the liquid outlet of the spray head is in contact with the second gas, and the pressure of the second gas is the second air pressure.

The device 900 includes a second control module 902, which is configured to: control the second air pressure to change within a second negative pressure range so that the second negative pressure is greater than the first negative pressure; wherein the first air pressure and the second air pressure change synchronously in the same preset period.

In some embodiments, when the first air pressure and the second air pressure change synchronously in the same preset period, the difference between the first air pressure and the second air pressure is within the preset difference range.

In some embodiments, the second negative pressure range includes a second maximum value and a second minimum value of the second air pressure; the second control module 902 is specifically configured to: control the second air pressure to change between the second maximum value and the second minimum value, so that the position of the liquid level formed by the ink in the ink cavity and the spray holes correspondingly changes between the first position and the second position.

Wherein the second position is far away from the ink cavity relative to the first position.

Figure 12:
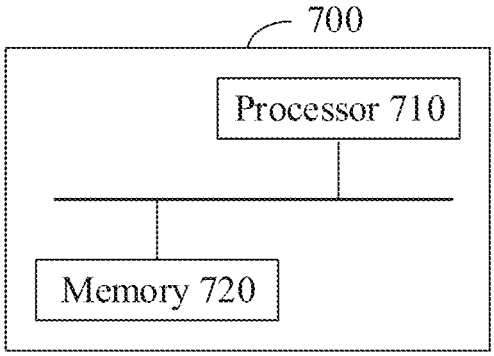
FIG. 12 is a schematic view of the hardware structure of a controller according to an embodiment of the present application.

FIG. 12 schematically shows a schematic view of the hardware structure of a controller. As shown in FIG. 12, the controller 700 includes: one or more processors 710 and a memory 720, wherein one processor 710 is taken as an example in FIG. 7.

The processor 710 and the memory 720 may be connected by a bus or other means, and the bus connection is taken as an example in FIG. 7.

As a nonvolatile computer readable storage medium, the memory 720 may be used to store nonvolatile software programs, nonvolatile computer executable programs and modules, such as program instructions/modules (e.g., the first control module 901 shown in FIG. 10) corresponding to the method in the embodiment of the present application. The processor 710 executes various functional applications and data processing of the inkjet printer, i.e., implements the maintenance method and the printing method provided by the above embodiments of the method, by running the nonvolatile software programs, instructions and modules stored in the memory 720.

The memory 720 may include a program storage area and a data storage area, wherein the program storage area may store operating systems and application programs required by at least one function; and the data storage area may store data created according to the use of the cleaning device for the spray head or the like. In addition, the memory 720 may include a high-speed random-access memory, and may also include a nonvolatile memory, such as at least one magnetic disk memory device, flash memory device, or other nonvolatile solid-state memory devices. In some embodiments, the memory 720 optionally includes memories remotely provided relative to the processor 710, and these remote memories may be connected to the cleaning device for the spray head through a network. Examples of the above network include, but not limited to, the Internet, Intranet, local area networks, mobile communication networks and combinations thereof.

The one or more modules are stored in the memory 720, and when executed by the one or more processors 710, the one or more modules execute the maintenance device for the spray head in any of the embodiments of the method described above, e.g., execute the method step 51 in FIG. 5, the method steps 51 to 52 in FIG. 6 and the method steps 81 to 84 in FIG. 9 described above, and implement the functions of the functional module 901 in FIG. 10 and the functional modules 901 to 902 in FIG. 11.

The products described above may execute the method provided according to the embodiments of the present application, and have corresponding functional modules and beneficial effects for executing the method. For technical details not described in detail in this embodiment, reference may be made to the method provided according to the embodiments of the present application.

An embodiment of the present application provides a nonvolatile computer readable storage medium, in which computer executable instructions are stored. The computer executable instructions, when executed by one or more processors, e.g., one processor 710 in FIG. 7, may enable the one or more processors described above to execute the cleaning device for the spray head in any of the embodiments of the method described above, e.g., execute the method step 51 in FIG. 5, the method steps 51 to 52 in FIG. 6 and the method steps 81 to 84 in FIG. 9 described above, and implement the functions of the functional module 901 in FIG. 10 and the functional modules 901 to 902 in FIG. 11.

The embodiments of the devices described above are only for illustrative purpose, wherein the units illustrated as separate components may be or may not be physically separated, and components displayed as units may be or may not be physical units; that is, these units and components may be located in one place or distributed over multiple network units. Some or all of the modules may be selected according to actual needs to achieve the purpose of the solution of the embodiment.

It shall be noted that the specification and attached drawings of the present application show the preferred embodiments of the present application; however, the present application may be implemented in many different forms, and it is not limited to the embodiments described in this specification, these embodiments are not construed as additional restrictions on the content of the present application, but are provided for a more thorough and comprehensive understanding of the disclosure of the present application. Moreover, the above technical features continue to be combined with each other to form various embodiments not listed above, all of which are regarded as the scope recorded in the specification of the present application; further speaking, those of ordinary skill in the art can make improvements or variations according to the above description, and all these improvements and variations shall fall within the scope claimed in the appended claims of the present application.

What is claimed is:

1. A maintenance system for a spray head comprising:

a controller;

an ink circulation loop, comprising a main container, a first regulating device and a spray head which are arranged in sequence along the ink delivery direction, the first regulating device being respectively connected with the main container and the spray head through pipelines, the spray head being connected with the main container, the first regulating device being connected with the controller;

wherein the main container is configured to store ink;

the first regulating device comprises a first accommodating cavity for storing first gas and ink flowing in from the main container, the first regulating device is configured to regulate a first air pressure of the first gas;

the spray head comprises an ink cavity and a plurality of spray holes, the ink cavity is in communication with the external environment through the spray holes, and the ink cavity is connected with the first accommodating cavity and the main container through pipelines; and the controller is configured to control the first air pressure to change within a first negative pressure range by the first regulating device to make the ink in the ink cavity oscillate, when the ink in the ink circulation loop is in a circulating flow state; wherein an oscillation direction of the ink comprises the length direction of the spray holes.

2. The system according to claim 1, wherein the first negative pressure range comprises a first maximum value and a first minimum value of the first air pressure;

the controller is specifically configured to control the first air pressure to change between the first maximum value and the first minimum value by the first regulating device, so that the position of the liquid level formed by the ink in the ink cavity and the spray holes correspondingly changes between a first position and a second position; wherein the second position is far away from the ink cavity relative to the first position.

3. The system according to claim 1, wherein the controller is specifically configured to control, by the first regulating device, the first air pressure to change periodically within the first negative pressure range according to a preset period to make the ink in the ink cavity oscillate periodically.

4. The system according to claim 1, wherein the ink circulation loop further comprises a second regulating device respectively connected with the spray head and the main container through pipelines;

wherein the second regulating device comprises a second accommodating cavity for storing second gas and ink flowing in from the spray head, and the second regulating device is configured to regulate a second air pressure of the second gas;

the controller is further configured to control the second air pressure to change within a second negative pressure range by the second regulating device so that the negative pressure in the second accommodating cavity is larger than the negative pressure in the first accommodating cavity; wherein the first air pressure and the second air pressure change in the same preset period.

5. The system according to claim 4, wherein the difference between the first air pressure and the second air pressure which is changed in the same preset period, is within a preset difference range.

6. The system according to claim 4, wherein the second negative pressure range comprises a second maximum value and a second minimum value of the second air pressure;

wherein the controller is further specifically configured to control the second air pressure to change between the second maximum value and the second minimum value by the second regulating device, so that the position of the liquid level formed by the ink in the ink cavity and the spray holes correspondingly changes between the first position and the second position; wherein the second position is far away from the ink cavity relative to the first position.

7. The system according to claim 4, wherein the second regulating device comprises:

a second container comprising the second accommodating cavity;

a second air pressure regulating device communicatively connected with the controller, wherein the second air pressure regulating device is connected with a gas delivery port of the second container through a pipeline, and the second air pressure regulating device is configured to regulate the second air pressure;

a second detection device, being communicatively connected with the controller and used for detecting the second air pressure;

wherein the controller is configured to acquire detection data of the second air pressure through the second detection device, and control the second air pressure to change within the second negative pressure range through the second air pressure regulating device according to the detection data of the second air pressure.

8. The system according to claim 7, wherein the ink circulation loop further comprises a second ink conveying device respectively connected with the second container and the main container through pipelines, and the second ink conveying device is configured to convey the ink contained in the second container to the main container.

9. The system according to claim 1, wherein the first regulating device comprises:

a first container comprising the first accommodating cavity;

a first air pressure regulating device communicatively connected with the controller, wherein the first air pressure regulating device is connected with a gas delivery port of the first container through a pipeline, and the first air pressure regulating device is configured to regulate the first air pressure;

a first detection device, being communicatively connected with the controller and used for detecting the first air pressure;

wherein the controller is specifically configured to acquire detection data of the first air pressure through the first detection device, and control the first air pressure to change within a first negative pressure range through the first air pressure regulating device according to the detection data of the first air pressure.

10. The system according to claim 9, wherein the ink circulation loop further comprises a first ink conveying device respectively connected with the main container and the first container through pipelines, and the first ink conveying device is configured to convey the ink contained in the main container to the first container.

11. The system according to claim 10, wherein the ink circulation loop further comprises a first ink processing device respectively connected with the first container and the first ink conveying device through pipelines and the first ink processing device is configured to purify the ink output from the first ink conveying device.

12. The system according to claim 9, wherein the ink circulation loop further comprises a second ink processing device, and the second ink processing device is respectively connected with the first container and the spray head through pipelines and the second ink processing device is configured to purify the ink output from the first container.

13. An inkjet printer, comprising the system according to claim 1.

14. A maintenance method for a spray head, wherein the spray head comprises a liquid inlet, a liquid outlet, an ink cavity and a plurality of spray holes, wherein one end of the ink cavity is in communication with the liquid inlet, the other end of the ink cavity is in communication with the liquid outlet, and the ink cavity is in communication with the external environment through the spray holes, and the air pressure at the end of the liquid inlet of the spray head is a first air pressure;

wherein the maintenance method comprises:

controlling the first air pressure to change within a first negative pressure range to make the ink in the ink cavity oscillate, when the ink flows through the liquid inlet, the ink cavity and the liquid outlet in sequence along the ink delivery direction, wherein the oscillation direction of the ink comprises the length direction of the spray holes.

15. The method according to claim 14, wherein the first negative pressure range comprises a first maximum value and a first minimum value of the first air pressure and the step of controlling the first air pressure to change within a first negative pressure range to make the ink in the ink cavity oscillate comprises:

controlling the first air pressure to change between the first maximum value and the first minimum value so that the position of the liquid level formed by the ink in the ink cavity and the spray holes correspondingly changes between a first position and a second position; wherein the second position is far away from the ink cavity relative to the first position.

16. A printing method applied to an inkjet printer, wherein the inkjet printer comprises a spray head and the printing method comprises:

acquiring work order data of an image to be printed;

controlling the spray head to print on a printing medium according to the work order data;

maintaining the spray head according to the method of claim 15 during the idle time of printing;

after the spray head maintenance is completed, acquiring new work order data and controlling the spray head to print on the printing medium.

17. The method according to claim 14, wherein the step of controlling the first air pressure to change within a first negative pressure range to make the ink in the ink cavity oscillate comprises:

controlling the first air pressure to change periodically within the first negative pressure range according to a preset period to make the ink in the ink cavity oscillate periodically.

18. The method according to claim 14, wherein the air pressure at the end of the liquid outlet of the spray head is a second air pressure and the maintenance method further comprises:

controlling the second air pressure to change within a second negative pressure range so that the second negative pressure is greater than the first negative pressure; wherein the first air pressure and the second air pressure change in the same preset period.

19. The method according to claim 18, wherein the difference between the first air pressure and the second air pressure which is changed in the same preset period, is within a preset difference range.

20. The method according to claim 18, wherein the second negative pressure range comprises a second maximum value and a second minimum value of the second air pressure and the step of controlling the second air pressure to change within a second negative pressure range comprises:

controlling the second air pressure to change between the second maximum value and the second minimum value, so that the position of the liquid level formed by the ink in the ink cavity and the spray holes correspondingly changes between the first position and the second position; wherein the second position is far away from the ink cavity relative to the first position.

* * * * *